United States Patent [19]

King et al.

[11] 3,932,289

[45] Jan. 13, 1976

[54] PREPARATION OF OVERBASED CARBONATED SULFURIZED MAGNESIUM ALKYLPHENATES

[75] Inventors: John M. King, San Rafael; Nicolaas Bakker, Pinole, both of Calif.

[73] Assignee: Chevron Research Company, San Francisco, Calif.

[22] Filed: Nov. 9, 1973

[21] Appl. No.: 414,585

[52] U.S. Cl. ..... 252/42.7; 252/18; 252/25

[51] Int. Cl.[2] ..... C10M 1/54

[58] Field of Search ..... 252/18, 25, 42.7

[56] References Cited

UNITED STATES PATENTS 3,801,507 4/1974 Hendrickson et al. ..... 252/18 X 3,810,837 5/1974 Chafetz et al. ..... 252/18 X

*Primary Examiner*—Delbert E. Gantz

*Assistant Examiner*—Andrew H. Metz

*Attorney, Agent, or Firm*—G. F. Magdeburger; C. J. Tonkin; L. L. Priest

[57] ABSTRACT

A process is disclosed for preparing overbased carbonated sulfurized magnesium alkylphenates. In the process, magnesium methoxide is carbonated and then contacted with an alkylphenol to form a normal magnesium phenate. The normal magnesium phenate is sulfurized and then contacted with an additional amount of carbonated magnesium methoxide to form the overbased sulfurized magnesium phenate.

6 Claims, No Drawings

PREPARATION OF OVERBASED CARBONATED SULFURIZED MAGNESIUM ALKYLPHENATES

BACKGROUND OF THE INVENTION

In the internal combustion engine by-products from the combustion chamber often blow by the piston and admix with the lubricating oil. Many of these by-products form acidic bodies within the lubricating oil leading to the formation of sludge and corrosive bodies detrimental to the engine bearings and parts. Typical acidic bodies produced include sulfur acids, produced from the oxidation of sulfur-containing compounds in the fuel, hydrohalic acids, derived from halogen lead scavengers in the fuel, and nitrogen acids, produced from the oxidation of atmospheric nitrogen within the combustion chamber.

It has been found that these acidic bodies cause degradation of the lubricating oil to form sludges which settle out on parts of the engine. The acid bodies also are corrosive to the metal bearings and parts of the engine causing rapid wear and early breakdown of the engine.

Overbased calcium and barium sulfurized phenates have been employed to neutralize the acid bodies and to disperse sludge within the lubricating oil. Although the overbased barium and calcium phenates neutralize the acid bodies and are quite effective detergents; they do not possess the desired degree of rust inhibition needed for a more complete protection of the engine parts. Magnesium phenates have been developed which do impart a higher degree of rust inhibition to the lubricating oil. These magnesium phenates, however, are more expensive and are considerably more difficult to prepare.

It is, therefore, an object of this invention to provide an improved method for preparing overbased magnesium phenates.

It is an additional object of this invention to provide a method for preparing overbased magnesium sulfurized alkylphenates.

It is another object of this invention to provide a method for preparing overbased magnesium sulfurized alkylphenates from process steps which do not employ sulfurized alkylphenol as a starting material.

Other and further objects of this invention will become apparent upon the following description of the invention.

SUMMARY OF THE INVENTION

I have found that the aforementioned objects and their attendant advantages can be realized by the following process. In the process, an overbased sulfurized magnesium alkylphenate is prepared by the steps of:

a. forming a first mixture of C1 to C3 magnesium alkoxide in a lower alkanol solvent and carbonating the mixture with 1.5 to 4, preferably 1.8 to 3.7 weight parts of carbon dioxide per weight part of magnesium at a temperature from 20° to 100°C and preferably from 20° to 60°C;

b. contacting the carbonated first mixture with a C8 to C35 (preferably C10 to C30) alkylphenol at a temperature from 20° to 150°C (preferably 20° to 100°C) at a pressure sufficient to maintain liquid phase to form a normal magnesium phenate and by-product C1 to C3 alkanol, the amount of said alkylphenol contacted being from 0.5 to 2 mole (preferably 0.8 to 1.4 mols) per mol of magnesium contacted;

c. contacting said normal magnesium phenate with 0.8 to 3.0 mols (preferably 1.0 to 2.0) mols of sulfur per mol of alkylphenol in said normal magnesium phenate at a temperature of 130° to 250°C, preferably from 150° to 200°C to form a sulfurized magnesium phenate and by-product hydrogen sulfide; and d. contacting said sulfurized magnesium phenate with a sufficient amount of said carbonated first mixture to provide from 0.1 to 2.0 (preferably 0.2 to 1.0) molar parts of carbonated magnesium alkoxide per molar part of alkylphenol in said sulfurized magnesium phenate, said contacting being conducted at a temperature from 20° to 120°C (preferably from 20° to 100°C) for a period sufficient to form the overbased sulfurized magnesium phenate.

By conducting the reaction in the above manner, elemental sulfur may be used in the sulfurization step without going through a sulfur dichloride sulfurization step. Generally, sulfur dichloride must be employed in order to sulfurize an alkylphenol. With the sulfurization step as described herein, elemental sulfur is employed and from 30 to 65 weight percent and more usually from 40 to 60 weight percent of the sulfur is incorporated into the sulfurized product. In addition, the process steps of this invention may be performed without the presence of a hydrocarbon solvent which is normally employed in other magnesium phenate processes. Additionally, when sulfur dichloride is employed to sulfurize the alkylphenol, most of the sulfurized products are dimers and trimers. By sulfurizing the magnesium phenate an oligomer is produced having usually between 4 and 6 alkylphenate groups.

The exact mechanism of the overbased carbonated sulfurized magnesium phenates in exhibiting superior rust inhibition, base reserve and antioxidation properties is unknown. Although these mechanisms are unknown, it is known, on the other hand, that these compounds exhibit good properties and possess high base reserve when incorporated into lubricating oils.

DETAILED DESCRIPTION OF THE INVENTION

The overbased carbonated sulfurized magnesium alkylphenates of this invention may be prepared by a four-step processing scheme. In a first step, a magnesium alkoxide is prepared by contacting magnesium with a C1 to C3 alkanol, preferably methanol, at a temperature of 20° to 100°C. Generally, magnesium turnings are simply admixed with alkanol in a stirred reactor and slowly dissolved. Usually from 250 to 500 weight percent excess of the alkanol is employed over that required for complete conversion of the magnesium to magnesium alkoxide.

The magnesium alkoxide is then carbonated by contacting the magnesium alkoxide in a lower C1 to C4 alkanol solvent, typically methanol, with carbon dioxide. Usually from 1.0 to 2.0 mols and more preferably from 1.5 to 1.9 mols of carbon dioxide per mol of magnesium methoxide is contacted with the magnesium alkoxide solution. This contacting may be conducted at a temperature of 20° to 100°C, and preferably from 20° to 60°C.

The contacting is conducted for a period sufficient to absorb 1.0 to 2.0 mols of carbon dioxide per mol of magnesium alkoxide. The actual time involved varies over a wide range depending whether a pressurized system is employed. However, if atmospheric pressure is involved, the contacting time generally varies from 1 to 5 hours.

In a second step, the mixture of carbonated magnesium alkoxide in the lower alkanol solvent is contacted with an alkylphenol at a temperature of 20° to 150°C, preferably from 65° to 85°C. The amount of alkylphenol contacted with the magnesium alkoxide solution generally varies from 0.5 to 2 mols, preferably from 0.8 to 1.4 mols and more preferably from 0.9 to 1.1 mols per mol of magnesium present within the contacting zone. During the contacting, the carbonated magnesium alkoxide reacts with the alkylphenol to form a normal carbonated magnesium phenate and by-product C1 to C3 alkanol. An excess of the alkylphenol is generally present so that very little if any unreacted magnesium alkoxide remains in the solution.

In a preferred embodiment, the alkylphenol is first dissolved in a long chain fatty alcohol, such as tridecyl alcohol, prior to the contacting with the carbonated magnesium alkoxide solution. The long chain fatty alcohol acts as a mutual solvent for the magnesium alkoxide and the alkylphenol, thereby allowing improved contacting of the two reactants. It is recognized, however, that the presence of the fatty alcohol is not necessary to effect the reaction. If the long chain fatty alcohol is not present, vigorous agitation of the two solutions will achieve a significant contacting of the two reactants to form the normal magnesium phenate.

The by-product alkanol and lower alkanol solvent is preferably removed at the end of the reaction of magnesium alkoxide with the alkylphenol. The by-product alkanol may also be removed continuously as it is formed during the reaction.

In another step of the process, the normal magnesium phenate is sulfurized. In this step, the normal magnesium phenate solution is contacted with 0.8 to 3.0 mols, preferably from 1.0 to 2.0 mols and more preferably from 1.5 to 2.0 mols of sulfur per mol alkylphenol in the normal magnesium phenate. The contacting is conducted at a temperature from 130° to 250°C, preferably from 150° to 200°C and more preferably from 175° to 190°C for a period sufficient to complete the reaction as indicated by a cessation (a substantial reduction) of the evolution of hydrogen sulfide from the mixture. Generally this contacting period is from 2 to 12 hours and more usually from 4 to 12 hours at the above conditions.

Upon sulfurizing the neutral magnesium phenate, a significant amount of by-product hydrogen sulfide gas is evolved. This gas may be removed at the end of the sulfurization step or, preferably, it is removed continuously as it is formed during the reaction. This removal may be accomplished by applying a vacuum to 5 to 20mmHg to the system while maintaining the temperature from 175° to 190°C.

Generally, the sulfurized magnesium phenate is quite viscous and difficult to handle. Therefore, the addition of a diluent oil is usually preferred in order to reduce the viscosity of the product. Thus, in this embodiment, from 0.1 to 1.0 weight parts of diluent oil are added for each weight part of sulfurized magnesium phenate present within the solution.

The last reaction step comprises overbasing the normal sulfurized magnesium phenate prepared above. In this step, a sulfurized magnesium phenate solution is contacted with an additional amount of the carbonated magnesium alkoxide solution so as to provide 0.1 to 2.0 and preferably from 0.2 to 1.0 mols of carbonated magnesium alkoxide added for each molar part of alkylphenol in the sulfurized magnesium phenate. In a most preferred embodiment, from 0.4 to 0.8 mols of carbonated magnesium alkoxide are added for each mol of alkylphenol in the sulfurized magnesium phenate. The contacting is conducted at a temperature from 20° to 120°C and preferably from 20° to 100°C and more preferably from 65° to 85°C.

By-product alkanol and lower alkanol solvent present within the overbasing solution is preferably removed by heating to a temperature of 70° to 200°C. A mixture of water and lower alkanol in the ratio of 1:1 to 1:10, preferably in a ratio to 1:3 to 1:6 may be added to the reaction mixture. The water reacts with the carbonated magnesium methoxide causing a greater percentage of the alkanol to be recovered in the final stripping steps.

The by-product methanol and lower alkanol solvent present within the reaction mixture may be removed by heating the mixture to a temperature of 100° to 210°C while maintaining a pressure of 50 to 750 mmHg absolute on the system. The long chain fatty alcohol may also be removed at this point by heating to 175° to 210°C at a pressure of 5 to 50 mmHg absolute.

The final product has a metal content which generally ranges from 2 to 7 weight percent and a sulfur content from 1 to 8 weight percent. The alkalinity value (ASTM Test D-2896) of the overbased sulfurized metal phenate generally ranges from 150 to 300 mg of KOH per gram and more usually from 200 to 250 mg of KOH per gram. The final product also has a base ratio of 0.5 to 2.0 and preferably from 1.1 to 1.4. Overbased materials are characterized by a metal content in excess of that stoichiometrically required by the reaction of the metal with the particular phenate. The base ratio is the ratio of the chemical equivalents of excess metal in the product to the chemical equivalents of the metal stoichiometrically required to react with the alkylated phenol.

REACTANTS

Alkylated Phenol

The alkylated phenols useful in this invention are of the formula:

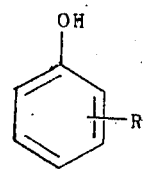

wherein R may be a straight chain or a branch chain alkyl group having from 8–35 carbon atoms and preferably from 10–30 carbon atoms. The R group or alkyl group may be present on any of the sides around the phenolic ring, i.e., ortho, meta, or para. Preferably, the R groups will predominately be meta or para. That is, less than 40% of the R groups will be in the ortho position and preferably less than 15% of the R groups will be in the ortho position. A particularly preferred alkalated phenol is polypropylene phenol, having from 8–20 carbon atoms in the polypropylene group. Examples of suitable alkyls include octyl, decyl, dodecyl, ethylhexyl, tricontyl, etc.; radicals derived from petroleum hydrocarbons such as white oil, wax, olefin polymers (e.g., polypropylene, polybutylene, etc.), etc. While one specific structure is indicated by the above formula, it should be recognized that mixtures of alkylated phenols can be successfully employed in the practice of this invention, including more than one alkyl group on each phenol radical.

Lower Alkanol

The lower alkanol which may be employed as a solvent in this invention includes C1 to C4 alkanols. Exemplary of these alkanols include methanol, ethanol, propanol, isopropanol, butanol, secondary butyl alcohol, etc. The preferred lower alkanol solvent is methanol.

Long Chain Fatty Alcohol

The long chain fatty alcohol which may be employed in this invention include the C10 to C18 fatty alcohols. Exemplary alcohols of this type include decyl alcohol, undecyl alcohol, dodecyl alcohol, tridecyl alcohol, tetradecyl alcohol, pentadecyl alcohol, hexadecyl alcohol, heptadecyl alcohol, and octadecyl alcohol. Usually from 0.3 to 1.0 weight parts of long chain fatty alcohol are employed per weight part of alkylphenol employed in the contacting.

Diluent Oil

The diluent oil employed in the subject invention is preferably a mineral lubricating oil obtained from paraffinic, naphthenic, asphaltic, or mixed base crudes, and/or mixtures thereof, having a flash point above about 240°C. The reaction diluent serves to reduce the viscosity of the sulfurized intermediate and the overbased sulfurized metal magnesium phenate product to make them readily transferable by pumping operations and the like. Mineral lubricating oils are preferred since the ultimate use of the overbased sulfurized magnesium phenate is in oil additives. However, any inert water-insoluble organic medium which would not react or interfere with the reaction of the process would be suitable. A particularly preferred reaction diluent is a refined mid-continent neutral oil having a viscosity from 50 to 300 SUS at 100°F (37.5°C).

PREPARATION OF LUBRICANT COMPOSITION

The lubricant composition of this invention can be prepared by simply mixing the overbased sulfurized metal phenate solution produced in the above step within a suitable lubricating oil or lubricant composition. The concentration of overbased metal phenate within the lubricating oil composition to realize the superior antioxidant and base reserve properties varies depending upon the type of overbased sulfurized magnesium phenate selected, the particular properties desired and the type of lubricating oil selected. Generally, however, the concentration of the overbased sulfurized magnesium phenate ranges from 0.2 to 20 weight percent and more preferably from 2 to 8 weight percent of the lubricating oil composition. Thus, lubricating oils generally have a magnesium content derived from the subject overbased phenate between about 0.01 to 1.0 weight percent.

The lubricating oil which may be employed in the practice of this invention includes a wide variety of hydrocarbon oils such as naphthenic base, paraffin base and mixed base hydrocarbon lubricating oils. The oils generally have a viscosity of 20 to 200 SUS at 210°F (98.8°C). Exemplary oils which may be employed include lubricating oils derived from coal products and synthetic oils, e.g., alkylene polymers (such as, polymers of propylene, butylene, etc., and mixtures thereof), alkylene oxide-type polymers (e.g., alkylene oxide polymers prepared by polymerizing alkylene oxide, e.g., propylene oxide polymers, etc., in the presence of water or alcohols, e.g., ethylene alcohol), carboxylic acid esters (e.g., those which were prepared by esterifying such carboxylic acids as adipic acid, azelaic acid, suberic acid, sebacic acid, alkenyl succinic acid, furmaric acid, maleic acid, etc., with the alcohols such as butyl alcohol, hexyl alcohol, 2-ethylhexyl alcohol, etc.), liquid esters of acids of phosphorus, alkyl benzenes, polyphenols (e.g., biphenols and terphenols), alkyl biphenol ethers, polymers of silicon, e.g., tetraethyl silicate, tetraisopropyl silicate, tetra(4-methyl-2-tetraethyl) silicate, hexyl(4-methyl-2-pentoxy)disilicone, poly(methyl)siloxane, and poly(methylphenyl)siloxane, etc. The lubricating oils may be used individually or in combinations, whenever miscible or whenever made so by the use of mutual solvents.

In addition to the overbased sulfurized magnesium phenate, other additives may be successfully employed within the lubricating composition of this invention. Exemplary additional additives include stabilizers, extreme pressure agents, oxidation inhibitors, pour point depressants, lubricating agents, viscosity index improvers, color correctors, odor control agents, ashless dispersants, metal deactivators, anticorrodants, etc.

The following examples are presented to illustrate the practice of specific embodiments of this invention and should not be interpreted as limitations upon the scope of the invention. The following example illustrates the preparation of representative overbased sulfurized magnesium phenates of this invention. As employed in the example, the processing steps utilized are batch processing. However, it is recognized that either continuous or batch processing schemes may be employed to realize the overbased sulfurized magnesium phenate of this invention. Modifications to continuous processing is within the skill of the art and, in order to be concise, an independent discussion of continuous processing is not presented.

EXAMPLE I

In this example a representative overbased sulfurized magnesium phenate is prepared. A solution of carbonated magnesium methoxide is prepared by charging into a 200 liter stainless steel reactor 90,800 g of substantially anhydrous methanol. The temperature of the methanol is raised to 40°C and the reactor vented to a scrubber. Approximately 230 g of purified magnesium turnings are added followed by 2 g of sublimed iodine to initiate the magnesium methoxide formation reaction. Thereafter, a total of 7260 g of magnesium are added to the methanol solution over a period of 5 hours. Approximately 450 g of methanol are taken overhead during the course of the reaction. The mixture is stirred for 1 hour after the last amount of magnesium is added in order to insure completion of the reaction.

While maintaining the mixture at 52°–63°C, carbon dioxide is added to the mixture through a bubbler tube. A total of 15,890 g of carbon dioxide are absorbed over a carbonation period of 2¼ hours. At the end of the carbonation step, the mixture is cooled to 38°C and a sample analyzed. The mixture has an alkalinity the value of 310 and contains 6.7% magnesium and 36 weight percent of methyl magnesium carbonate.

To a 40 liter stainless steel reactor vented to a caustic scrubber, 6,840 g of tetrapropylene phenol and 4,370 g of tridecyl alcohol are charged. The mixture is heated to 70°C and 6,080 g of the carbonated magnesium methoxide prepared above is charged over a period of 1¾ hours. During the 1¾ hours, the temperature of the mixture is raised to 120°C and a total of 3,100 g of methanol are recovered overhead. The pressure is reduced to 250 mm of mercury and the temperature raised to 180°C and held 1 hour. An additional 500 g of methanol containing a trace amount of tridecyl alcohol are taken overhead. The intermediate megnesium phenate has a specific gravity of 0.951, a viscosity at 210°F (98.8°C) of 652 SUS and an alkalinity value of 122 mg of KOH per gram.

The mixture is warmed to 110°C and 1,630 g of elemental sulfur are added. The temperature is then raised to 177°–182°C and held for 7 hours. A total of 446 g of hydrogen sulfide are evolved during the course of the reaction and taken off overhead during the reaction. At the end of the sulfurization step, 5,700 g of lube oil diluent are added and the reaction mixture allowed to cool to 77°C. Thereafter, an additional 8,800 g of the carbonated magnesium methoxide solution are charged to the mixture. The temperature is maintained at 74°–77°C and 3,820 g of methanol are taken off overhead over a 2½ hour additional period. A mixture of 475 ml of water and 1,140 ml of methanol is added during a ¼ hour period. The mixture is then heated to 120°C for 1¼ hours during which 2,600 g of methanol are taken overhead. The pressure in the reactor is reduced to 385 mm of mercury, the temperature raised to 155°C and 600 g of a solution containing 92% methanol and 8 weight percent tridecyl alcohol are recovered overhead. The pressure is reduced to 35 mm of mercury and the temperature raised to 204°C and held there for 1 hour to recover overhead 1,550 g material which has a composition of 3.5% methanol, 96% tridecyl alcohol, and 0.5% other. The product is then filtered and a sample thereof analyzed to reveal the following:

| | |
|---|---|
| Viscosity at 210°F (98.8°C) | 733 |
| Alkalinity value mg KOH/g | 228 |
| Magnesium weight percent calc. | 4.95 |
| Magnesium weight percent analyzed | 4.42% |
| Sulfur weight percent | 4.52 |

EXAMPLE 2

This example is presented to demonstrate the improved lubricating properties of the subject compositions as compared to conventional carbonated sulfurized calcium phenates. The tests are performed under severe conditions as exist in a 1.24 BMEP (Units MNm-2) or 180 BMEP (Units PSI) Caterpillar diesel engine.

In the tests, a lubricating oil is combined with (1) a conventional overbased sulfurized calcium phenate prepared by reacting tetrapropenyl phenol with calcium hydroxide and sulfur in the presence of ethylene glycol and carbonating the reaction product (the product contains 9.25 weight percent calcium, 3.73 weight percent sulfur) and (2) an overbased sulfurized magnesium phenate of the type prepared by Example I containing 4.87 weight percent sulfur and having an alkalinity value of 254 mg of KOH per gram. The oils tested had identical formulations except that the two different sulfur-base sulfurized metal phenates were used as additives.

The one cylinder diesel engine employed had a bore of 5⅛ inches and a stroke of 6½ inches. The brake power is 41KW (55bhp) and the engine is run at 131KW from the fuel (7,460 BTU per minute) and 1800 rpm with the air temperature at 124°C (255°F), the outlet water temperature at 88°C (190°F), the oil-to-bearing temperature at 96°C (205°F), and a fuel containing 0.5 weight percent sulfur.

The engine tests are carried out for 60 hours at which time the engines are torn down and inspected and then reassembled and run for an additional 60 hours for a total of 120 hours, with the results shown in Table I.

TABLE I

CATERPILLAR ENGINE TEST

| Phenate | Test Hours | Rating | | | | | | | | |
|---|---|---|---|---|---|---|---|---|---|---|
| | | Grooves[1] | | | | Lands[2] | | | Underhead[3] | |
| | | 1 | 2 | 3 | 4 | 1 | 2 | 3 | | |
| Magnesium Phenate | 60 | 43 | 0.5 | 0.5 | 0.7 | 25 | 20 | 15 | L[4] | 6.1 |
| (ex. 1) | 120 | 65 | 0.6 | 0.5 | 0.6 | 30 | 45 | 35 | L | 5.3 |
| Calcium Phenate | 60 | 65 | 5.1 | 0.5 | 0.6 | 130 | 10 | 15 | L | 4.6 |
| (Conventional) | 120 | 83 | 5.0 | 0.5 | 0.5 | 95 | 30 | 35 | L | 4.5 |

[1]Groove Deposits rated on the basis of 0–100, 100 being completely filled grooves.
[2]Land Deposits rated on the basis of 0–800, 800 being completely black.
[3]Underhead Deposits rated on the basis of 0–10, 10 being completely clean.
[4]L is lacquer.

The above table illustrates the superiority of the magnesium phenate over a conventional calcium phenate. As shown, the groove, land and underhead deposits for the calcium phenate were greater than with the magnesium phenate tested.

We claim:

1. A process for preparing an overbased sulfurized magnesium phenate which comprises:

a. forming a first mixture of a $C_1$ to $C_3$ magnesium alkoxide in a lower alkanol solvent and carbonating the mixture with 1.5 to 4 weight parts of carbon dioxide per weight part of magnesium;

b. contacting said carbonated first mixture with a $C_8$ to $C_{35}$ alkylphenol at a temperature from about 20° to 150°C to form a normal magnesium phenate, the amount of alkylphenol contacted being 0.5 to 2 mols per mol of magnesium contacted;

c. contacting said normal magnesium phenate with 0.8 to 3.0 mols of sulfur per mol of alkylphenol in said normal magnesium phenate at a temperature of 130° to 250°C to form a sulfurized magnesium phenate and by-product hydrogen sulfide; and d. contacting said sulfurized magnesium phenate with a sufficient amount of said carbonated first mixture to provide from 0.1 to 2.0 molar parts of carbonated magnesium alkoxide per molar part of alkylphenol in said sulfurized magnesium phenate, said contacting being conducted at a temperature from 20° to 120°C.

2. The process defined in claim 1 wherein said magnesium alkoxide is magnesium methoxide.

3. The process defined in claim 2 wherein the contacting of said carbonated first mixture and said alkylphenol is in the presence of a solvent amount of a long chain fatty alcohol.

4. The process defined in claim 2 wherein a diluent hydrocarbon oil is present during the contacting of said sulfurized magnesium phenate and said carbonated first mixture.

5. The process defined in claim 4 wherein said overbased sulfurized magnesium phenate has a sulfur content between about 1 and 8 and a magnesium content between about 2 and 7.

6. The process defined in claim 5 wherein said alkylphenol is a polypropylene phenol having from 8 to 20 carbons in the polypropylene group.

* * * * *